US007631391B2

(12) United States Patent
Cabrero Gomez et al.

(10) Patent No.: US 7,631,391 B2
(45) Date of Patent: Dec. 15, 2009

(54) HEAD FOR A STRIP MOP

(75) Inventors: Estrella Cabrero Gomez, Madrid (ES); Maria del Carmen Martin Rivera, Madrid (ES); Carmen Echeverria Alonso, Madrid (ES); Maurizio Beolchi, Milan (IT); Christophe C. Corsi, Neuilly sur Seine (FR); Patrice P. Freyermuth, Bessancourt (FR); Eric A. Soyer, Levallois (FR); Mauro Porcini, Milan (IT); Sigurdur Thorsteinsson, Milan (IT); Peter J. Newbould, Milan (IT)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/598,428

(22) PCT Filed: Feb. 23, 2005

(86) PCT No.: PCT/US2005/005818

§ 371 (c)(1),
(2), (4) Date: Aug. 30, 2006

(87) PCT Pub. No.: WO2005/087076

PCT Pub. Date: Sep. 22, 2005

(65) Prior Publication Data

US 2007/0169292 A1 Jul. 26, 2007

(30) Foreign Application Priority Data

Mar. 1, 2004 (GB) ..... 0404524.1

(51) Int. Cl.
*A47L 13/20* (2006.01)
*A47L 13/24* (2006.01)

(52) U.S. Cl. ..... 15/229.2; 15/147.1; 15/151; 15/229.1

(58) Field of Classification Search ..... 15/147.1, 15/147.2, 151, 228, 229.1–229.9
See application file for complete search history.

(56) References Cited

U.S. PATENT DOCUMENTS 957,025 A * 5/1910 Zachry ..... 15/229.2

(Continued)

FOREIGN PATENT DOCUMENTS

CN 1242975 6/1943

(Continued)

*Primary Examiner*—Mark Spisich
(74) *Attorney, Agent, or Firm*—Trisha D. Adamson

(57) ABSTRACT

A head (1) for a strip mop comprises a hollow dome-shaped body (3) which is attachable at its top to one end of an elongate mop handle (4). Web material is secured within the body (3) so that a portion hangs down from the base of the dome-shaped body to provide the cleaning substrate (2) of the mop. To facilitate access to confined areas of a surface that is being cleaned, such as corners, the base of the dome-shaped body (3) of the mop head has the general form of an equilateral triangle. A spacer (17, FIG. 4) is provided between two adjacent layers of the web material within the dome-shaped body, to enhance the volume of the cleaning substrate (2); and a peripheral skirt (8) of a more resilient material is provided at the base of the wall of the dome-shaped body (3) to reduce the risk of damage to surfaces that might be impacted by the mop head (1) when in use.

21 Claims, 6 Drawing Sheets

U.S. PATENT DOCUMENTS

| | | | | | |
|---|---|---|---|---|---|
| 1,806,402 | A | | 5/1931 | Lorang | |
| 2,320,372 | A | | 6/1943 | McCarthy | |
| 2,781,537 | A | * | 2/1957 | Le Febvre et al. | 15/146 |
| 3,328,822 | A | * | 7/1967 | Sellesi | 15/151 |
| 3,703,738 | A | * | 11/1972 | Moss et al. | 15/229.2 |
| 4,114,224 | A | | 9/1978 | Disko | |
| 4,531,251 | A | | 7/1985 | Pappas et al. | |
| 5,862,565 | A | | 1/1999 | Lundstedt | |
| 6,253,408 | B1 | | 7/2001 | Feld et al. | |
| 6,543,082 | B2 | | 4/2003 | Dingert et al. | |

FOREIGN PATENT DOCUMENTS

| | | | | |
|---|---|---|---|---|
| CN | 1193265 | | | 9/1998 |
| EP | A 0 537 963 | B1 | | 9/1995 |
| EP | 739600 | | * | 10/1996 |
| EP | 844844 | | * | 10/2001 |
| EP | 1362544 | | * | 11/2003 |
| GB | A 2 191 937 | A | | 6/1987 |
| GB | A 2 255 712 | A | | 11/1992 |
| JP | 5-199974 | | * | 8/1993 |
| WO | WO 92/14064 | | | 8/1992 |
| WO | WO 96/08194 | A1 | | 3/1996 |
| WO | 96/32048 | | * | 10/1996 |
| WO | WO 97/06722 | | | 2/1997 |
| WO | WO 00/71014 | A1 | | 11/2000 |
| WO | WO 01/12052 | A1 | | 2/2001 |

* cited by examiner

HEAD FOR A STRIP MOP

FIELD

The present invention relates to strip mops, especially for use in cleaning floors, and is particularly concerned with providing an improved head for such a mop.

BACKGROUND

Many different forms of mop are known. Generally, they comprise an elongate handle to one end of which is attached a head in which a cleaning substrate is secured. In a strip mop, the cleaning substrate is a web material selected for the type of surfaces on which the mop is to be used, with an absorbent web material being preferred for wet cleaning. The web material is secured in the mop head so that a length of the material (typically about 20-30 cm) hangs down from the head and will wipe the surface to be cleaned when the mop head is moved over the latter. Typically, several layers of web material are secured together in the mop head and, over at least a part of their length, are subdivided into strips of about 1 cm in width. Conventionally, dome-shaped mop heads are employed since they facilitate the arrangement of the web material in an effective manner and are also visually pleasing.

Examples of dome-shaped strip mop heads employing various forms of web material are described, for example, in U.S. Pat. No. 4,114,224; U.S. Pat. No. 6,253,408; WO 96/08194; WO 97/06722; and EP-A-0 537 963.

Other known types of mops include string mops, in which the cleaning substrate is a bundle of absorbent strings or fibres that hang down from the mop head; and flat mops in which the cleaning substrate is generally either a flat sponge or an absorbent web material held against a lower flat face of the mop head. Examples of string mops are described in GB-A-2 191 937; GB-A-2 255 712; U.S. Pat. No. 1,806,402; U.S. Pat. No. 4,531,251; and WO 92/14064. An example of a typical flat mops is described in WO 01/12052.

For use in the domestic environment, many consumers show a preference for strip mops for wet cleaning because the cleaning substrates can be highly absorbent and can also be wrung-out very effectively, thereby simplifying and speeding-up the task of wet cleaning a large surface such as a floor. However, a continuing problem with all mops (including strip mops) is that it can be difficult to access certain areas of surfaces such as the corners of a floor.

In the particular case of a flat mop for use in cleaning confined vertical or slanted surfaces such as vehicle windows, it as been proposed in U.S. Pat. No. 5,862,565 to provide a mop head with a diamond shape, to allow the head to extend into small angular areas of a surface to be cleaned. In WO 00/71014, it has been proposed to provide a round or oval mop head with an angled part to facilitate cleaning corners and, in the field of strip mops, it has been proposed in U.S. Pat. No. 6,543,082 to provide a mop head with boundary edges that are curved to form two corners, stated to be for the purpose of improved operability and suitability for cleaning corners The present invention is directed to problem of providing an effective strip mop that will facilitate access to confined or angular areas of a surface such as the corners of a floor. The invention is further concerned with enhancing the general appearance and potential effectiveness of a strip mop, and with reducing the possibility that the mop head will damage either the surface that is being cleaned or objects and surfaces adjacent thereto.

SUMMARY

The present invention provides a head for a strip mop, comprising a hollow dome-shaped body which is attachable at its top to one end of an elongate mop handle and within which web material is secured so that a portion thereof hangs down from the base of the dome-shaped body to provide the cleaning substrate of the mop; wherein the base of the dome-shaped body has the general form of an equilateral triangle. When a mop head of that type is being used, for example to clean a floor, any of the angled parts of the dome-shaped body can easily fit into a 90° corner of the floor, and the fact that the dome-shaped body has three such angled parts will enable the user to maneuver the body into the corner without difficulty, regardless of its orientation.

The present invention further provides a head for a strip mop, comprising a hollow dome-shaped body which is attachable at its top to one end of an elongate mop handle and within which a plurality of superposed layers of web material are secured so that a portion of each layer hangs down from the base of the dome-shaped body to provide the cleaning substrate of the mop; wherein a spacer is provided between two adjacent layers of the web material within the dome-shaped body. The spacer enables the outer layer(s) of web material to stand out over the inner layer(s), thereby enhancing the overall fullness of the mop head and increasing the possibility that more of the material at any one time will be in contact with the surface that is being cleaned.

In accordance with yet another aspect, the present invention provides a head for a strip mop, comprising a hollow dome-shaped body which is attachable at its top to one end of an elongate mop handle and within which web material is secured so that a portion thereof hangs down from the base of the dome-shaped body to provide the cleaning substrate of the mop; wherein a substantial part of the dome-shaped body is formed from a first material, and a peripheral skirt of a more resilient material is provided at the base of the wall of the dome-shaped body. The peripheral skirt of a mop head in accordance with this aspect of the invention assists in reducing the risk of damage to a surface that may be impacted by the mop head when in use.

BRIEF DESCRIPTION OF THE DRAWINGS

By way of example only, mop heads constructed in accordance with the present invention will now be described with reference to the accompanying drawings, in which.

DETAILED DESCRIPTION

Figure 1:
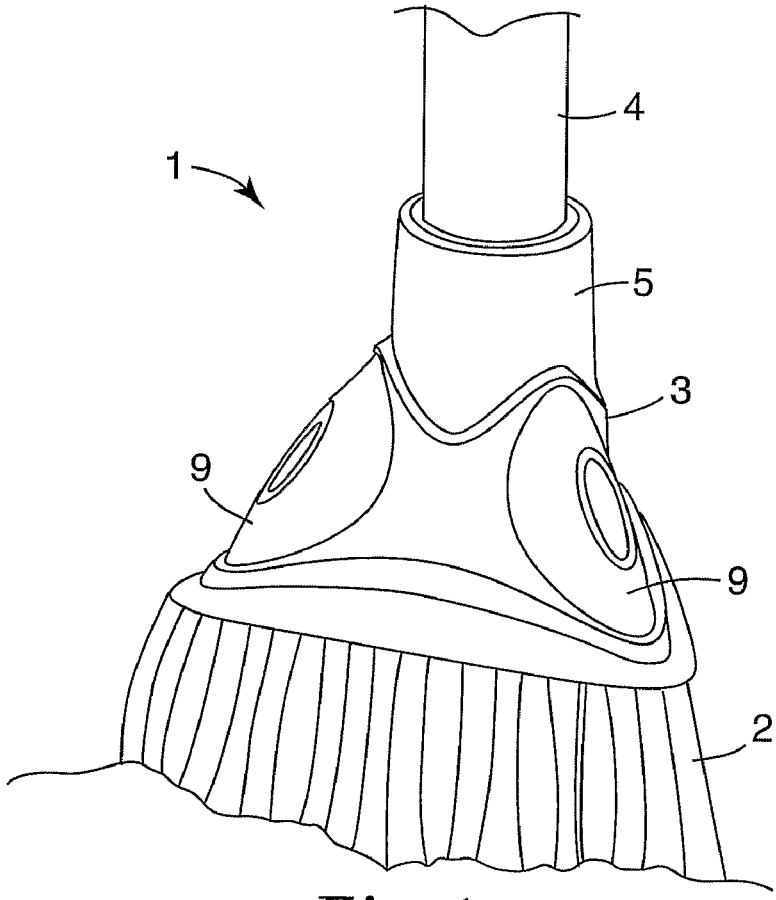
FIG. 1 is a perspective view of a strip mop having a mop head in accordance with the invention.

The mop shown in FIG. 1 has a head 1 comprising a plurality of fabric strips 2 (the full length of which is not shown) secured in a dome-shaped body 3 which is attached at its top to one end of an elongate mop handle 4 (the full length of which is also not shown). The strips 2 hang down from the base of the body 3 to provide the cleaning substrate of the mop.

Figure 2:
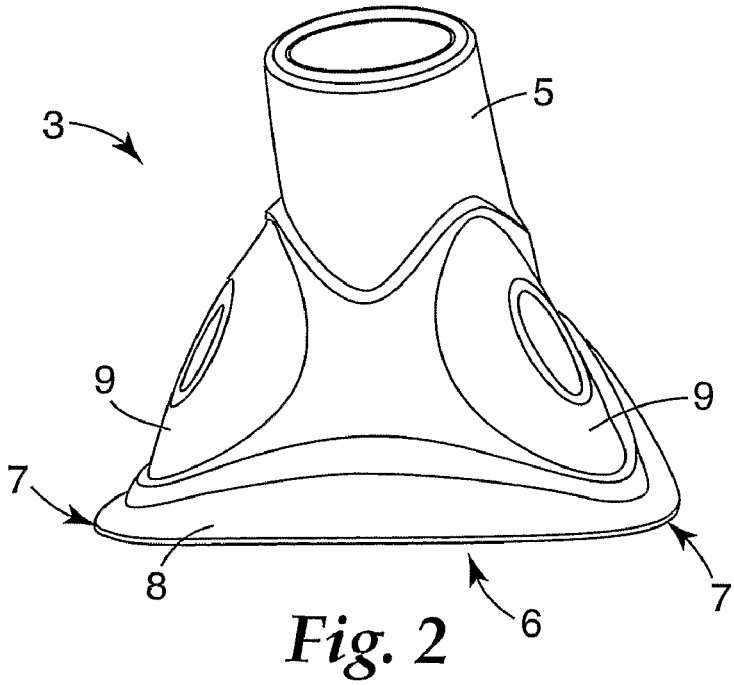
FIG. 2 shows the dome-shaped body of the head of the mop of FIG. 1.

The strips 2 are formed from a web material known to be suitable for use in the head of a mop. In the case of a mop for wet cleaning of floors, the strips are formed from an absorbent material and typically extend for about 20 cm from the base of the body 3. The absorbent web material may, for example, be a non-woven material; an extruded material; or a sponge material. The body 3, which is also shown in FIG. 2 and will be described in greater detail below, is formed from suitable polymeric materials (for example polypropylene) while the handle 4 is a conventional mop handle formed, for example, from wood or metal and possibly covered with a plastic material. For the purposes of attaching the dome-shaped body 3 to the handle 4, an upstanding cylindrical socket 5 is provided at the top of the body into which the handle may be a push-fit or screw-threaded.

Figure 3:
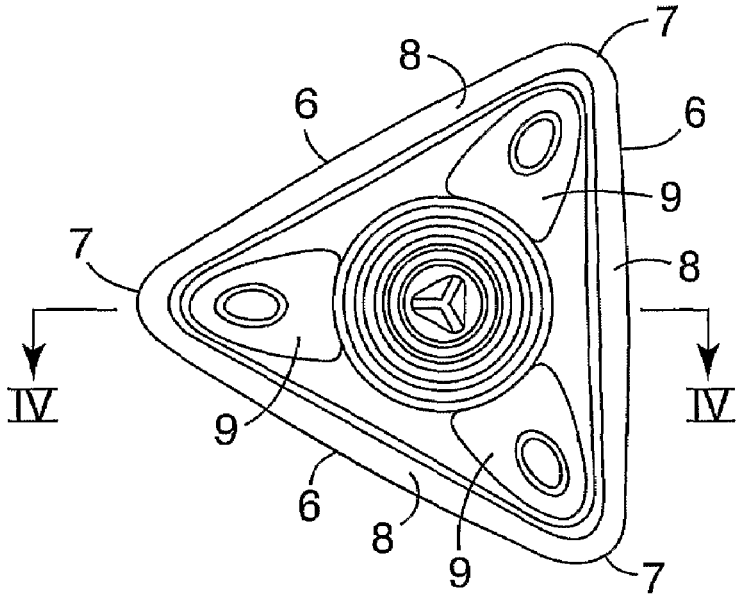
FIG. 3 is a plan view of the dome-shaped body of FIG. 2.

To facilitate the cleaning of angular areas of a surface, for example the corners of a floor, the base of the dome-shaped body 3 of the mop head 1 has the general form of an equilateral triangle. In other words, as can be seen from FIG. 3, the base has three sides 6 of equal length and three equal angled parts 7, all of which are slightly rounded to reduce the possibility of damage to surfaces that may be impacted by the mop when in use. Any of the angled parts 7 can fit easily into a 90° corner of a floor, and the fact that the dome-shaped body 3 has three such angled parts enables the user of the mop to maneuver the body 3 into a 90° corner without difficulty (i.e. regardless of the orientation of the body 3 relative to the corner).

Figure 4:
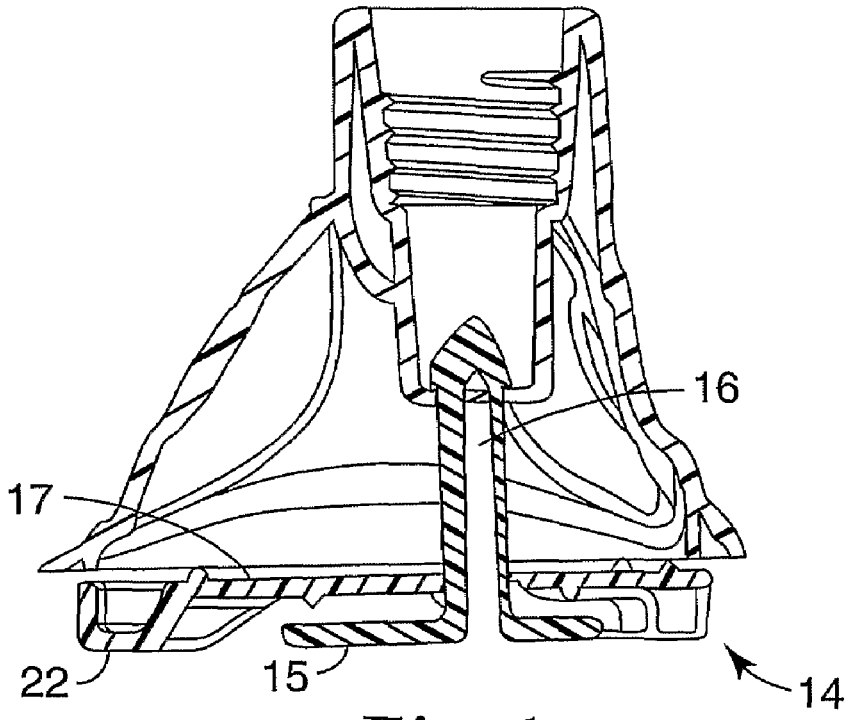
FIG. 4 shows a cross-section on the line IV-IV of FIG. 3.

To reduce further the possibility of damage to surfaces that may be impacted by the mop when in use, a peripheral skirt 8 of a more resilient material is formed at the bottom of the dome-shaped body 3. Advantageously, as shown in FIGS. 2 and 4, the skirt 8 flares outwards from the body 3 to enhance the ability of the mop head 1 to penetrate into confined areas. Regions 9 of a similar more resilient material are also provided on the outside of the dome-shaped body 3, on the lines joining the vertices of each of the angled parts 7 to the top of the body. The main part of the body 3 and the more resilient regions 8, 9 may be formed from different types of the same material, for example polypropylene, polypropylene copolymers or modified polypropylenes. Alternatively, the more resilient regions 8, 9 may be formed from a rubber material. The whole of the dome-shaped body 3 may be formed by a conventional two-step moulding process.

Figure 5:
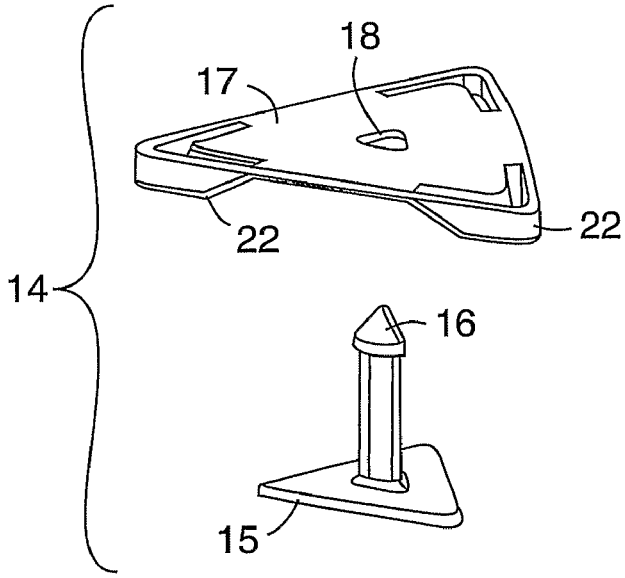
FIG. 5 is an exploded view of a carrier that forms part of the head of the mop of FIG. 1.
Figure 6:
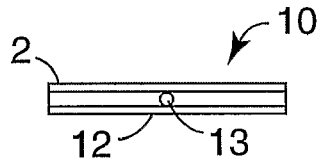
FIG. 6 shows one piece of web material used in a strip assembly for the head of the mop of FIG. 1.

The strips 2 are provided by an assembly of superposed pieces 10 of web material, each having an elongate rectangular shape as shown in FIG. 6. Strips 2 are formed by cutting the rectangular piece of material 10 inwards from each end, leaving a central section 12 which is uncut. The central section 12 is provided with a single central aperture 13, the purpose of which will be described below. A plurality of the pieces 10, arranged in a star formation, is located on a carrier 14 (as described below with reference to FIGS. 5 and 7) to form a strip assembly 11 which is then secured within the dome-shaped body 3 of the mop head 1.

The carrier 14 comprises two parts: a base 15 with an upstanding pin 16, and a spacer 17 (see FIG. 5). The base 15 and the spacer 17 are both generally flat components having the shape of an equilateral triangle, like the base of the dome-shaped body 3, but the base 15 of the carrier is substantially smaller than the base of the dome-shaped body whereas the spacer 17 is substantially the same size or only slightly smaller. The spacer 17 has a central aperture 18 through which the pin 16 can pass before being secured to a boss 19 that extends downwardly from the top of the dome-shaped body 3, inside the latter. The lower end of the boss 19 is provided with an aperture into which the upper end of the pin 16 is inserted, that end of the pin being hook-shaped to ensure that the carrier 14 then remains secured within the dome-shaped body 3. On its lower side, the spacer 17 is provided with downwardly-extending peripheral ledges 22 in the region of the angled parts 7; the purpose of those ledges 22 will be described below.

Before the carrier 14 is inserted into the dome-shaped body 3, a first group 20 of pieces 10 of web material (see FIG. 7) is placed in a star formation on the base 15 by inserting the pin 16 through the aperture 13 in each piece. The spacer 17 is placed on top of that group 20 of pieces of web material, and a second group 21 of pieces 10 of web material is then placed in star formation on top of the spacers (again by inserting the pin 16 through the aperture in each piece). The strip assembly 11 is then complete and is inserted in the dome-shaped body 3 by securing the pin 16 in the boss 19 as described above, to complete the mop head 1, as illustrated diagrammatically in FIG. 8. The pin 16 has a triangular cross-section, and the aperture 18 in the spacer 17 as well as the aperture in the boss 19 is similarly-shaped thereby preventing both parts of the carrier 14 from rotating relative to the dome-shaped body.

The dimensions of both parts of the carrier 14 are such that, in the assembled mop head 1, the pieces of web material 10 in the upper group 21 (i.e. above the spacer 17) are held between the periphery of the spacer 17 and the bottom of the wall of the dome-shaped body 3. The pieces of web material 10 in the lower group 20 (i.e. below the spacer 17), on the other hand, are held between the lower surface of the spacer and the upper surface of the base 15. As a result, the strips 2 provided by the pieces of web material 10 in the upper group 21 will be held out over the strips 2 provided by the pieces of web material 10 in the lower group 20 which, in turn, will form the centre of the mop head 1: in that way, the mop head is provided with a greater degree of fullness than could otherwise be achieved. The fullness can be varied by changing the number of pieces of web material used in the upper and lower groups 20, 21, although it has been found that the best effect is generally achieved by using more pieces of web material in the upper group 21 than in the lower group 20. If desired, more than one spacer 17 could be used, with the upper spacer being of a larger size than the one below. The comparatively small size of the base 15 of the carrier assists not only in improving the fullness of the mop strips 2 but also in reducing the risk of damage that this part might cause to a surface that is being cleaned.

The ledges 22 on the lower side of the spacer 17 are provided to ensure that good contact is maintained between the strips 2 of the mop head 1 and the surface that is being cleaned, even in the region of the angled parts 7, particularly when the mop head is being driven into a corner. By way of explanation, referring to FIG. 8, it will be assumed that the angled part 7 shown in that drawing is being driven into a corner. During such a movement, the strips 2 of the web material 10 in the upper group 21 will tend to fold backwards underneath the leading angle of the spacer 17 while those in the lower group 20 will tend to fold backwards underneath the leading angle of the base 15. The presence of the ledge 22 underneath the leading angle of the spacer 17 ensures that the pressure exerted on the web material in this region will be comparable to that exerted on the web material in the central part of the mop head underneath the base 15, thus ensuring a uniform effect over the whole of the surface that is being cleaned. Depending on the exact form of the mop head 1, and the form and nature of the strips 2, the ledges 22 may not always be required, and can be omitted if the desired cleaning effect is achieved without them. It will also be appreciated that the ledges 22 need not be formed from the same material as the spacer 17 and could be replaced by other forms of downwardly-extending portions on the spacer 17 that will provide a similar effect.

In one mop head of the type 1 shown in FIG. 1, the sides of the equilateral triangle formed by the base of the dome-shaped body 3 are approximately 9.0 cm long, and the vertical height of the dome-shaped body 3 plus the socket 5 is approximately 7.0 cm. The downwardly-extending ledges 22 on the spacer 17 are about 0.8 cm high, and the pin 16 of the carrier 14 has a height of about 3.5 cm. The pieces 10 of web material are about 48.0 cm long and 6.0 cm wide and are cut each end into three equal strips.

Figure 9:
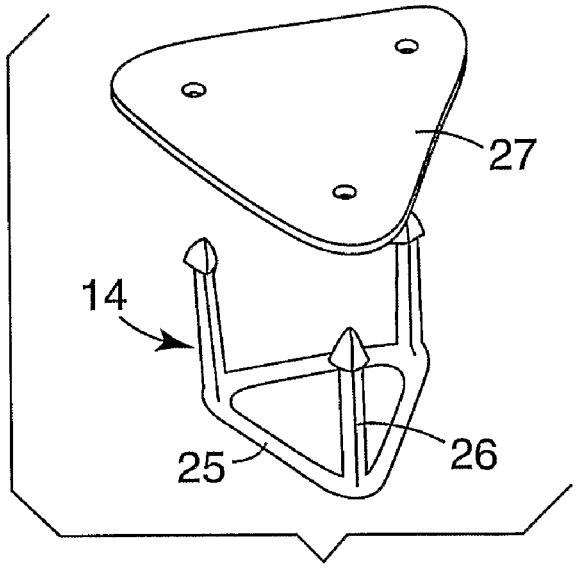
FIG. 9 corresponds to FIG. 5 but shows an alternative form of carrier.

FIG. 9 shows an alternative form of the carrier 14, in which the base of the carrier is formed from three struts joined to form a triangle 25 and has three upstanding pins 26 for connecting the carrier to the dome-shaped body 3 of the mop head 1. The spacer 27 is shown as a flat triangular plate, without the downwardly-extending ledges 22 of the spacer 17 of FIG. 5 (although similar ledges could be provided on the spacer 27 if required). When a carrier of this type is used, the ends of the pins 26 could engage in appropriately-located bosses on the inside of the dome-shaped body 3 of the mop head 1 or they could engage in apertures in the wall of the body (e.g. in the centres of the areas 9) so that they are visible on the outside of the body.

Figure 10A:
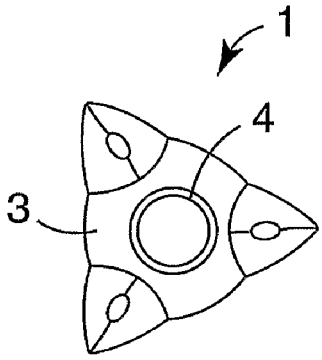
FIGS. 10*a* and 10*b* show, respectively, a plan view and a perspective view of an alternative form of the dome-shaped body of a mop head.
Figure 10B:
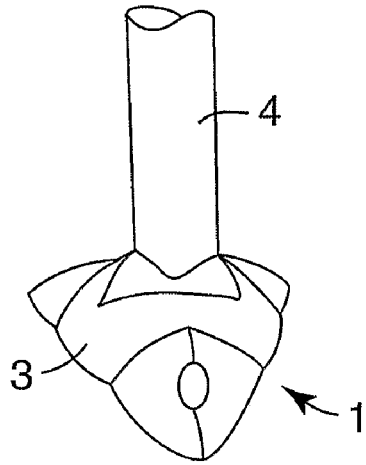
Figure 11A:
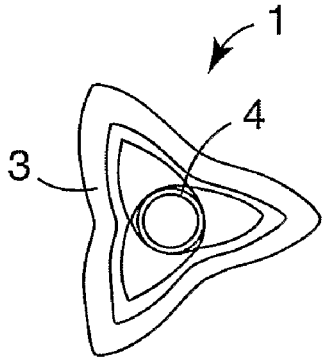
FIGS. 11*a* and 11*b*; 12*a* and 12*b*; and 13*a* and 13*b* show similar views of other forms of the dome-shaped body of a mop head.
Figure 11B:
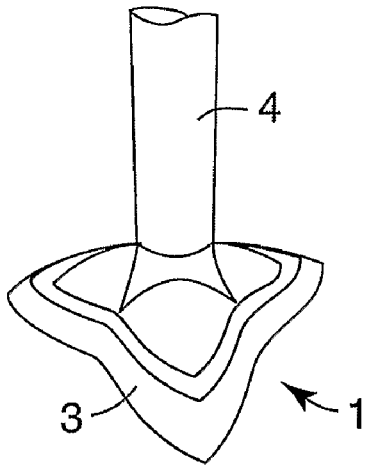
Figure 12A:
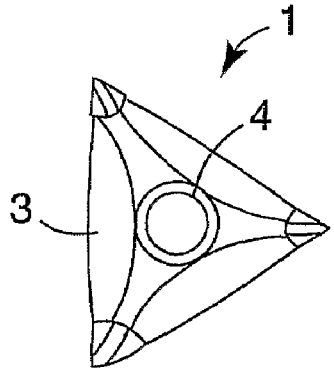
Figure 12B:
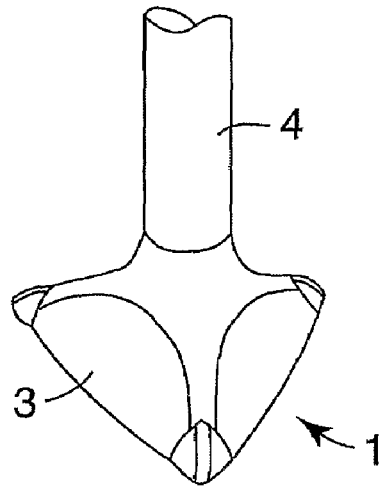
Figure 13A:
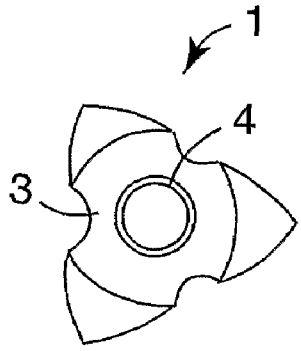
Figure 13B:
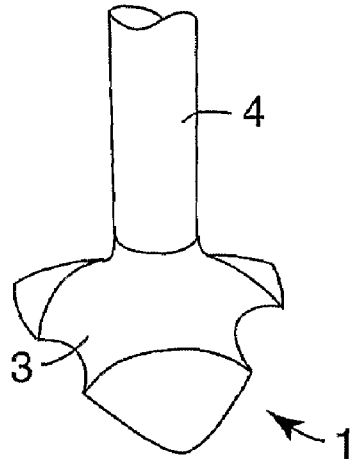

FIGS. 10 to 13 show alternative forms for the dome-shaped body of a mop head 1. Despite their differing shapes, each of these has a base that is generally in the form of an equilateral triangle and will provide improved access to areas such as the corners of a floor in a similar manner to the dome-shaped body 3 of FIG. 1. The dome-shaped body 3 shown in FIG. 10 is intended for use with a carrier 14 of the type shown in FIG. 9 having three upstanding pins 26, while those shown in FIGS. 11 to 13 are intended for use with carriers of the type shown in FIG. 5 having one upstanding pin.

It should be understood that the use of a spacer 17, 27 within the assembly of absorbent web material providing the strips 2 is not restricted to mop heads of the type shown in FIGS. 1 and 10 to 13. Suitably-shaped spacers could be used in strip mop heads of other shapes including, in particular, dome-shaped heads that have circular or oval bases as well as those that have one or two angled portions of less than 90° to provide access to corners (such as mop heads having the general shape illustrated in U.S. Pat. No. 6,543,082). In each of those cases, the spacer would have a peripheral shape similar to that of the base of the dome-shaped head of the mop heads and could also, if necessary, be provided with peripheral downwardly-extending ledges (similar to the ledges 22 of FIG. 5) to ensure uniform contact between the mop strips and the surface that is being cleaned.

It will also be appreciated that a peripheral resilient skirt, such as the skirt 8 of FIG. 1, could be employed with advantage on mop heads of other shapes (including mop heads with conventional circular or oval dome-shaped bodies as well as those with one or two angled portions only). Likewise, protective resilient regions similar to the regions 9 of FIG. 1 could also be employed on the outside surfaces of mop heads of other shapes.

Figure 7:
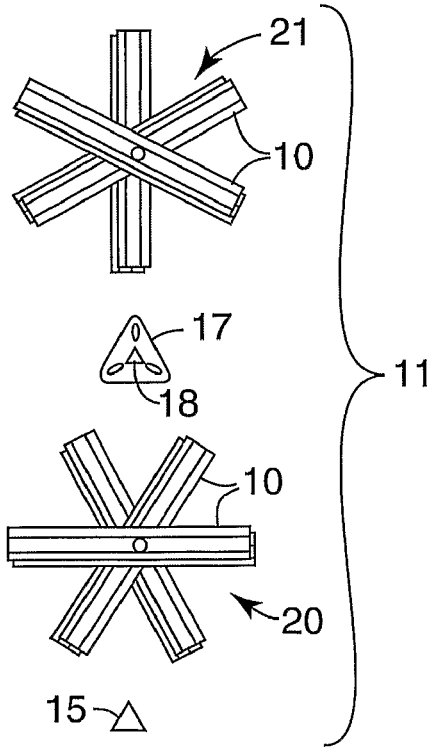
FIG. 7 is an exploded view illustrating the components of the whole strip assembly of the head of the mop of FIG. 1.
Figure 8:
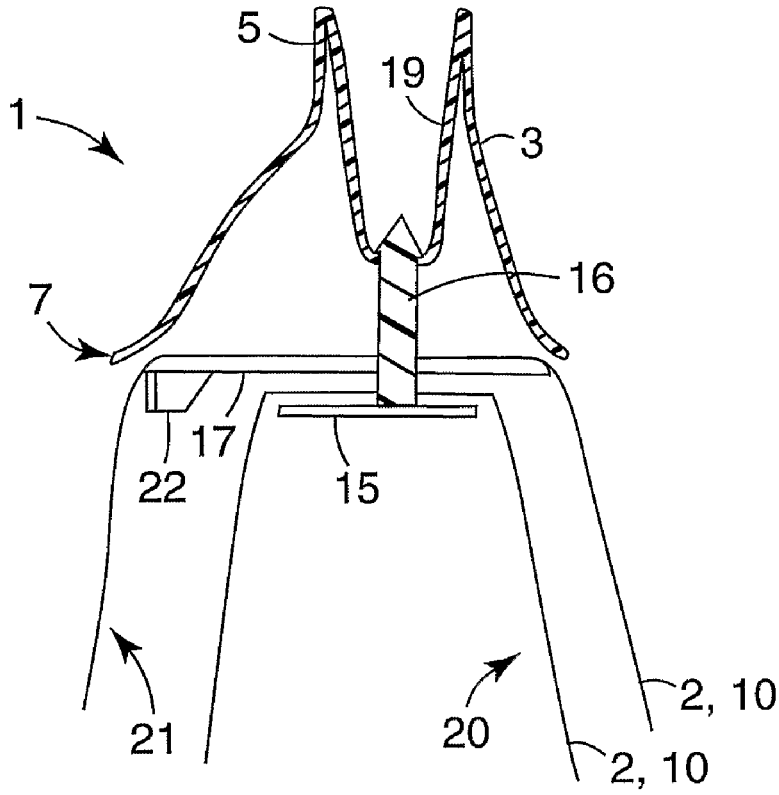
FIG. 8 is a diagrammatic cross-section corresponding to FIG. 4 but illustrating the whole strip assembly of FIG. 7 in place in the head of the mop.

The form of the pieces of web material 10 can also be varied. The dimensions given above are not essential and they could have a different length and/or width and be sub-divided into a different number of strips 2. A star-shaped arrangement of the web material 10 on the carrier 14, as illustrated in FIG. 7, is preferred because it provides a uniform amount of web material around the whole of the dome-shaped head 3 but the exact arrangement illustrated in FIG. 7, in which the pieces of web material 10 in each of the groups 20, 21 are arranged in three different directions, is not essential. Alternatively, the pieces 10 of web material could have a non-rectangular shape, and need not be sub-divided into strips 2. Furthermore, if strips 2 are provided, they need not have straight edges as illustrated in FIG. 6 but could have wavy or zigzag edges instead. Other suitable shapes for the pieces of web material are described in WO 97/06722.

The invention claimed is:

1. A head for a strip mop, comprising:

a hollow dome-shaped body which is attachable at its top to one end of an elongate mop handle and within which web material is secured so that a portion thereof hangs down from the base of the dome-shaped body to provide the cleaning substrate of the mop;

a carrier secured within the dome shaped body comprising a spacer and a base;

wherein web material located above the spacer is held between the periphery of the spacer and the base of the dome-shaped body; and wherein web material located below the spacer is held between the spacer and the base of the carrier;

wherein the base of the dome-shaped body has the general form of an equilateral triangle.

2. A mop head as claimed in claim 1, in which the said periphery of the carrier has a similar shape to, and is aligned with, the base of the dome-shaped body.

3. A mop head as claimed in claim 1, in which a plurality of superposed layers of web material are located on the carrier.

4. A mop head as claimed in claim 1, in which the periphery of the spacer has a similar shape to, and is aligned with, the base of the dome-shaped body.

5. A mop head as claimed in claim 1, in which the spacer is provided with a downwardly-extending portion, at least in the region of each angle of the said equilateral triangle, to enhance contact in those regions between the web material and a surface to be cleaned.

6. A mop head as claimed in claim 1, in which the base of the carrier has at least one upstanding pin that extends through the web material and secures the carrier to the dome-shaped body.

7. A mop head as claimed in claim 1, wherein a substantial part of the dome-shaped body is formed from a first material, and a peripheral skirt of a more resilient material is provided at the base of the wall of the dome-shaped body.

8. A mop head as claimed in claim 1, wherein a substantial part of the dome-shaped body is formed from a first material, and a part of the external surface of the body on a line joining a vertex of the said equilateral triangle to the top of the body comprises a more resilient material.

9. A head for a strip mop, comprising a hollow dome-shaped body which is attachable at its top to one end of an elongate mop handle and within which a plurality of superposed layers of web material are secured so that a portion of each layer hangs down from the base of the dome-shaped body to provide the cleaning substrate of the mop; wherein a spacer is provided between two adjacent layers of the web material within the dome-shaped body; wherein the base of the dome-shaped body has at least one vertex defining an angle of less than 90°, the spacer having a similarly-shaped vertex aligned with that of the dome-shaped body; and wherein the spacer is provided with a downwardly-extending portion, at least in the region of the said vertex, to enhance contact in that region between the web material and a surface to be cleaned.

10. A mop head as claimed in claim 9, in which the shape of the periphery of the spacer is similar to that of the base of the dome-shaped body.

11. A mop head as claimed in claim 9, in which the spacer forms part of a carrier which is secured within the dome-shaped body and on which the superposed layers of web material are located, the/each layer of web material located above the spacer being held between the periphery of the spacer and the base of the wall of the dome-shaped body.

12. A mop head as claimed in claim 11, in which the/each layer of web material located below the spacer is held between the spacer and a base of the carrier.

13. A mop head as claimed in claim 12, in which the shape of the periphery of the base of the carrier is similar to that of the spacer but the outer dimensions are substantially less.

14. A mop head as claimed in claim 11, in which the carrier has at least one upstanding pin that extends through the superposed layers of web material and secures the carrier to the dome-shaped body.

15. A head for a strip mop, comprising a hollow dome-shaped body which is attachable at its top to one end of an elongate mop handle and within which web material is secured so that a portion thereof hangs down from the base of the dome-shaped body to provide the cleaning substrate of the mop; wherein a substantial part of the dome-shaped body is formed from a first material, and a peripheral skirt of a more resilient material is provided at the base of the wall of the dome-shaped body; and wherein the base of the dome-shaped body has at least one vertex defining an angle of less than 90° and a part of the external surface of the body on a line joining the vertex to the top of the body also comprises a more resilient material.

16. A mop head as claimed in claim 15, in which the skirt flares outwards from the wall of the dome-shaped body.

17. A mop head as claimed in claim 15, in which the dome-shaped body is formed by moulding from a polymeric material.

18. A mop head as claimed in claim 15, in which the web material is located on a carrier that is secured within the dome-shaped body whereby web material is held between a periphery of the carrier and the base of the wall of the dome-shaped body.

19. A mop head as claimed in claim 18, in which the carrier has at least one upstanding pin that extends through the web material and secures the carrier to the dome-shaped body.

20. A mop head as claimed in claim 15, including an upstanding socket at the top of the dome-shaped body, by which the mop head can be attached to one end of an elongate mop handle.

21. A head for a strip mop, comprising:

a hollow dome-shaped body which is attachable at its top to one end of an elongate mop handle and within which web material is secured so that a portion thereof hangs down from the base of the dome-shaped body to provide the cleaning substrate of the mop; wherein the base of the dome-shaped body has the general form of an equilateral triangle, wherein a substantial part of the dome-shaped body is formed from a first material, and a part of the external surface of the body on a line joining a vertex of the said equilateral triangle to the top of the body comprises a more resilient material.

* * * * *

UNITED STATES PATENT AND TRADEMARK OFFICE

CERTIFICATE OF CORRECTION

PATENT NO. : 7,631,391 B2
APPLICATION NO. : 10/598428
DATED : December 15, 2009
INVENTOR(S) : Cabrero Gomez et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 572 days.

Signed and Sealed this

Second Day of November, 2010

David J. Kappos

David J. Kappos
*Director of the United States Patent and Trademark Office*